US009421663B2

(12) United States Patent
Thomaschewski et al.

(10) Patent No.: US 9,421,663 B2
(45) Date of Patent: Aug. 23, 2016

(54) GRINDING OR POLISHING TOOL FOR AN OSCILLATING DRIVE

(75) Inventors: Walter Thomaschewski, Filderstadt (DE); Rainer Mann, Aalen-Unterrombach (DE)

(73) Assignee: C. & E. FEIN GMBH (DE)

( * ) Notice: Subject to any disclaimer, the term of this patent is extended or adjusted under 35 U.S.C. 154(b) by 1533 days.

(21) Appl. No.: 12/707,396

(22) Filed: Feb. 17, 2010

(65) Prior Publication Data

US 2010/0210194 A1 Aug. 19, 2010

(30) Foreign Application Priority Data

Feb. 17, 2009 (DE) ..... 10 2009 010 569
Mar. 9, 2009 (DE) ..... 10 2009 013 370

(51) Int. Cl.
*B24B 23/04* (2006.01)
*B24B 23/02* (2006.01)
*B24B 23/03* (2006.01)

(52) U.S. Cl.
CPC ..... *B24B 23/04* (2013.01); *B24B 23/02* (2013.01); *B24B 23/03* (2013.01)

(58) Field of Classification Search
CPC ..... B24B 23/04; B24B 23/02; B24B 23/03
USPC ..... 451/548, 456, 350–359
See application file for complete search history.

(56) References Cited

U.S. PATENT DOCUMENTS 2,794,303 A * 6/1957 Wickes ..... 451/357
3,496,680 A * 2/1970 Hutchins ..... 451/357
3,510,992 A 5/1970 Hutchins
4,287,685 A * 9/1981 Marton ..... 451/359
5,123,216 A 6/1992 Kloss et al.
5,261,190 A * 11/1993 Berger et al. ..... 451/357
5,317,838 A * 6/1994 Bourner ..... 451/294
5,445,558 A * 8/1995 Hutchins ..... 451/344
5,607,343 A 3/1997 Keith, Jr. et al.
5,919,085 A * 7/1999 Izumisawa ..... 451/357

(Continued)

FOREIGN PATENT DOCUMENTS

DE 2520112 A1 11/1976
DE 20304073 U1 5/2003

(Continued)

OTHER PUBLICATIONS

European Search Report; Application No. EP 10 15 3709; Jul. 26, 2010; 6 pages.

(Continued)

*Primary Examiner* — George Nguyen
(74) *Attorney, Agent, or Firm* — St. Onge Steward Johnston & Reens, LLC

(57) ABSTRACT

The invention discloses a tool for grinding and polishing, comprising a drive motor, which has a given machine power (rated input power) and by which a work spindle can be driven about its longitudinal axis in rotatingly oscillating fashion, and further comprising a tool-mounting fixture on the work spindle intended to receive a tool that has a working surface for grinding and polishing operations. The quotient of the working surface (in square millimeters) and the rated power input (in Watts) is at least 35 $mm^2/W$, while the quotient of the working surface and the deadweight (in grams, without the tool) is at least 5.5 $mm^2/g$.

18 Claims, 3 Drawing Sheets

(56) References Cited

U.S. PATENT DOCUMENTS

| | | | | |
|---|---|---|---|---|
| 5,967,886 | A * | 10/1999 | Wuensch et al. | 451/356 |
| 6,413,157 | B1 | 7/2002 | Marton | |
| 6,551,180 | B2 * | 4/2003 | Braasch | 451/508 |
| 6,688,958 | B1 * | 2/2004 | Jones et al. | 451/557 |
| 6,945,862 | B2 | 9/2005 | Jasch et al. | |
| 6,969,311 | B2 * | 11/2005 | Chen et al. | 451/359 |
| 7,033,262 | B2 * | 4/2006 | Takizawa et al. | 451/490 |
| 7,094,138 | B2 * | 8/2006 | Chang | 451/359 |
| 7,217,177 | B2 * | 5/2007 | Frech et al. | 451/359 |
| 7,270,598 | B2 * | 9/2007 | Dutterer et al. | 451/357 |
| 7,713,110 | B2 * | 5/2010 | Lampka et al. | 451/357 |
| 8,007,346 | B2 * | 8/2011 | Dehde et al. | 451/344 |
| 8,113,921 | B2 * | 2/2012 | Krauss et al. | 451/357 |
| 2002/0142706 | A1 * | 10/2002 | Glashauser et al. | 451/41 |
| 2004/0005851 | A1 * | 1/2004 | MacKay | 451/359 |
| 2004/0038622 | A1 * | 2/2004 | Dehde | 451/1 |
| 2004/0053568 | A1 * | 3/2004 | Sieber | 451/357 |
| 2004/0058632 | A1 * | 3/2004 | Boyer | 451/344 |
| 2005/0003748 | A1 * | 1/2005 | Dutterer et al. | 451/357 |
| 2005/0079808 | A1 * | 4/2005 | Tiede et al. | 451/357 |
| 2006/0099888 | A1 * | 5/2006 | Ishibashi et al. | 451/38 |
| 2010/0056029 | A1 | 3/2010 | Grunikiewicz | |
| 2010/0261414 | A1 * | 10/2010 | Fronek | 451/28 |

FOREIGN PATENT DOCUMENTS

| | | | |
|---|---|---|---|
| DE | 10335301 | B3 | 3/2005 |
| DE | 202008001473 | U1 | 6/2008 |
| DE | 202008011959 | U1 | 2/2010 |
| EP | 0799675 | A1 | 10/1997 |
| GB | 2337013 | A | 11/1999 |
| WO | 8702924 | A1 | 5/1987 |
| WO | 9605939 | A1 | 2/1996 |

OTHER PUBLICATIONS

European Search Report; Application No. EP 10 17 0996; Nov. 24, 2010; 6 pages.

* cited by examiner

GRINDING OR POLISHING TOOL FOR AN OSCILLATING DRIVE

BACKGROUND OF THE INVENTION

The present invention relates to an oscillating tool having an oscillating drive with a drive motor by which a work spindle can be driven about its longitudinal axis in rotatingly oscillating fashion, wherein the work spindle can be connected with a tool that is equipped with a working surface for grinding or polishing.

An oscillating tool of that kind is known from WO 87/02924 A1.

The known oscillating tool comprises an oscillating drive with a work spindle on which a tool in the form of a grinding or polishing tool is secured against independent rotation, for example by a form-locking connection. The oscillating drive moves its work spindle about its longitudinal axis at high frequency and with a small pivoting angle, with the result that especially good grinding results can be achieved, especially when triangular grinding tools with rounded outer edges are used. For, in that case grinding along longitudinal edges and along corners is also made possible.

The afore-mentioned printed publication suggests that conventionally formed grinding and polishing tools can also be used in combination with the oscillating drive.

Starting out from the printed publication mentioned at the outset recent years have brought a progressive development of tools that are driven by an oscillating drive to perform the most different tasks. In addition to grinding and polishing all sorts of surfaces this also includes the use of the tool for sawing, cutting out joint material, and the like.

In practice it has, however, been found that the use of conventional polishing or grinding tools on oscillating drives of such a kind produces only little abrasion, especially in grinding operations. Accordingly, numerous tools for grinding or polishing operations have been developed for such oscillating drives that are adapted to the particular demands to be met when such tools are used in combination with oscillating drives. As a rule, such tools always have a relatively small working surface, because they are used for special operations and because it is expected that otherwise the grinding results might be impaired or overloading of such oscillating drives might occur.

Therefore, in practice eccentric grinders or oscillating grinders are now as before predominantly used for grinding larger surfaces.

SUMMARY OF THE INVENTION

In view of this, it is a first object of the present invention to disclose an oscillating tool having a tool for grinding or polishing that leads to improved grinding or polishing results.

It is a second object of the invention, to disclose an oscillating tool having a tool for grinding or polishing that leads to an improved micrograph and improved abrasion effect in a grinding or polishing operation.

According to the invention these and other objects are achieved by an oscillating tool of the kind described at the outset by an arrangement in which the quotient of the working surface of the tool (in square millimeters) and the rated power input of the drive motor (in Watts) is at least 35 $mm^2/W$.

Also the object of the invention is achieved, with an oscillating tool of the type described above, by an arrangement wherein the quotient of the working surface of the tool (in square millimeters) and the total weight of the oscillating tool (in grams, without the tool) is at least 5.5 $mm^2/g$.

The object of the invention is thus perfectly achieved.

It has been found according to the invention that those two quotients are important characteristics of the working capacity of the oscillating tool, especially with respect to surface grinding. The higher the power of the drive motor, the larger may be the working surface. Correspondingly, the working surface may in principle be made larger in proportion to the increase in weight of the oscillating tool.

The working surface of prior art devices always was strictly limited depending on the drive power of the oscillating drive, determined either by its rated power input or by its weight, as an excessively large working surface was considered to be a disadvantage. It was expected that an excessively large working surface would either result in poorer grinding results or even in overloading of, or damage to, the gearing or the motor of the oscillating drive.

The invention now deviates from that prejudice of the prior art and proposes to use a larger working surface.

The quotient of the working surface and the rated power input preferably may even be at least 40 $mm^2/W$.

Finally, the quotient of the working surface and the deadweight preferably may even be at least 6.0 $mm^2/g$ or even at least 7.0 $mm^2/g$.

In summary, the invention proposes the use of a larger working surface for the oscillating tool, compared with conventional oscillating tools, which makes the tool especially well suited for surface grinding.

The larger working surface of the oscillating tool preferably is combined with different features that serve to reduce the mass inertia of the tool received on the drive spindle. As a result, a larger working surface can be used in combination with unchanged drive power or unchanged weight, respectively.

The connection between the drive spindle and the tool preferably is of the form-locking type in order to guarantee safe power transmission even under high loads.

According to another embodiment of the invention, the tool comprises a carrier element adapted to receive a grinding or polishing material, as well as a driving element on which a form-locking element, preferably in the form of a mounting opening, is provided for positive connection with the work spindle of the oscillating drive, the driving element being connected with a back element on which the carrier element is fixed, the driving element having a higher strength than the back element, and the back element being made from a material of lower weight compared with the driving element.

The use of an additional back element, which on the one hand is fixed to the carrier element and which on the other hand is connected with the driving element, provides the possibility to make the tool as a whole more flexible and, especially, to give it a reduced mass inertia compared with a conventional tool of that kind.

By reducing the mass inertia, an improvement of the grinding or polishing results can be achieved. When the mass inertia is clearly reduced, compared with conventional tools, for example by the use of different materials, clearly improved grinding or polishing results can be achieved. Especially, higher abrasion can be achieved in combination with reduced loading of the machine.

Given the fact that the driving element has a greater strength than the back element, and that the back element is made from a material of lower weight compared with the driving element, the tool in its entirety is given sufficient strength to prevent wearing of the tool that is mounted on the form-locking driving element of the work spindle of the oscillating drive, even under high loads and in continuous operation. On the other hand, the back element that consists of a material of clearly lower weight, compared with the driving element, guarantees the required carrying function of the carrier element which latter normally consists of a resilient material such as a polyurethane foam material. These features altogether can guarantee the required stability of the entire tool whereas the mass inertia of the entire tool can be reduced, compared with a conventional structure of the tool.

Preferably, the driving element has a clearly smaller surface than the back element, providing the necessary stability only in the area of the form-locking seat. However, the back element preferably extends right to the outer edge of the carrier element in order to guarantee the required stability in the marginal areas as well. So, that combined structure allows the tool to be given a clearly reduced mass inertia; especially a reduced moment of inertia can be achieved with respect to the center axis of the form-locking mounting element by which the tool can be received on the working spindle of an oscillating drive.

It has been found that such a structure of the tool allows results, especially grinding results, to be achieved that are clearly better than the grinding efficiency of eccentric grinders, for example as regards the micrograph and the abrasion results. As a result, such tools can be used also and especially for large-surface operations, i.e. for surface grinding or polishing of larger areas.

According to a further embodiment of the invention, the driving element consists of a material having a Vickers hardness of at least 250 HV, preferably of at least 320 HV, the maximum hardness preferably being in the range of 840 HV. The particularly preferred range is in the order of 420±80 HV.

Similarly, the tensile strength of the material from which the driving element is made preferably may be in the range of 1100 to 2650 N/mm$^2$, more preferably in the range of 1500 to 1700 N/mm$^2$.

These features ensure that the strength of the driving element, in the area of its form-locking element, is sufficiently high to avoid wearing even under continuous operating conditions.

For example, the driving element may be made from steel, preferably from a hardened steel, which helps to arrive at low-cost structure.

However, it is understood that other materials that guarantee the necessary stability to avoid wearing in the area of the form-locking element, may be used as well.

According to another embodiment of the invention, the back element consists of an aluminum or a magnesium alloy.

Especially aluminum alloys are available at very low cost, are light in weight and have the necessary stability to support the carrier element even in its marginal areas.

According to a further embodiment of the invention, the back element consists of a plastic material or of a compound material.

Such a design permits the weight of the back element to be further reduced compared with a back element produced from aluminum or magnesium, for example. In summary, the mass inertia of the tool can be further reduced in this way so that the grinding or polishing efficiency of the tool can be further improved. In addition, plastic materials and/or compound materials can be produced in large numbers and at low cost.

According to another embodiment of the invention, the driving element is connected with the back element by welding, soldering or by gluing.

While a solid durable connection can be obtained by welding or soldering, gluing provides an especially low-cost production method. Depending on the adhesive used, a very strong connection can be achieved in this way as well.

According to another embodiment of the invention, the driving element has a plurality of openings that reduce the weight of the driving element.

This feature allows the mass inertia of the driving element, and accordingly also of the whole tool, to be further reduced, but still guarantees satisfactory stability.

Similarly, the back element may be provided with a plurality of openings that reduce the weight of the back element and, thus, the mass inertia.

According to another embodiment of the invention, the driving element is positively connected with the back element, preferably via projections of the back element that engage in matching openings of the driving element.

This feature allows an extremely strong connection to be achieved between the driving element and the back element, which will stand even high loads during operation. Especially when the back element is made from a plastic material, production can be realized at low cost because when the parts are produced by an injection molding process, for example, the corresponding raised portions or projections of the back element can be produced by the same molding step as the parts as such.

According to an additional further improvement of that embodiment, the projections of the back element are connected with the openings of the driving element by caulking or by fusing.

This feature provides an extremely strong and durable connection between the back element and the driving element, without any additional use of an adhesive.

Preferably, the driving element and the back element are plate-shaped, which guarantees a simple structure for the entire tool.

The carrier element preferably consists of an elastomeric material, for example a polyurethane foam material.

However, it is understood that depending on the particular application suitable other materials can be selected for the carrier element so that different materials may be used as well.

According to another embodiment of the invention, the tool is disk-shaped and has a diameter larger than 100 mm, preferably larger than 110 mm, in the area of its working surface.

It has been found that the when oscillating drives of the kind offered by Applicant under the designation Multimaster® or Supercut are used such an embodiment leads to especially good grinding results also in large-surface grinding operations. For example, it is possible in this case to use conventional abrasive materials of the kind offered by numerous manufacturers for grinding disks of a diameter of 115 mm.

According to a further embodiment of the invention, exhaust channels are provided which, beginning at the working surface, extend through the carrier element, the back element and through the driving element.

Accordingly, the tool according to the invention can be used also for grinding with simultaneous grit removal directly from the working area.

In consequence of the two-part design of the carrier element and the back element, increased constructional liberty is provided for the design and the arrangement of the exhaust channels, compared with conventional tools where the driving element simultaneously serves as support for the carrier element.

According to a further embodiment of the invention, the carrier element is provided with a fastening element on its side facing the tool, for detachably fastening the grinding or polishing material. Preferably, the fastening element may consist of a Velcro-type material, especially of a Velcro-type metal material.

This features makes it possible to use conventional grinding or polishing materials of which numerous kinds are offered for connection via a Velcro-type material. This guarantees easy changing of the grinding or polishing material.

It is understood that the carrier element may have a circular working surface, or else a working surface different from a circular shape, for example a triangular or rectangular working surface with rounded convex outer edges, a drop-shaped surface with a point on one side, or a surface of any other form.

It is further understood that that the features of the invention mentioned above and those yet to be explained below can be used not only in the respective combination indicated, but also in other combinations or in isolation, without leaving the scope of the invention.

BRIEF DESCRIPTION OF THE DRAWINGS

Further features and advantages of the invention will become apparent from the description that follows of certain preferred embodiments, with reference to the drawing. In the drawing

DETAILED DESCRIPTION OF THE PREFERRED EMBODIMENTS

Figure 1:
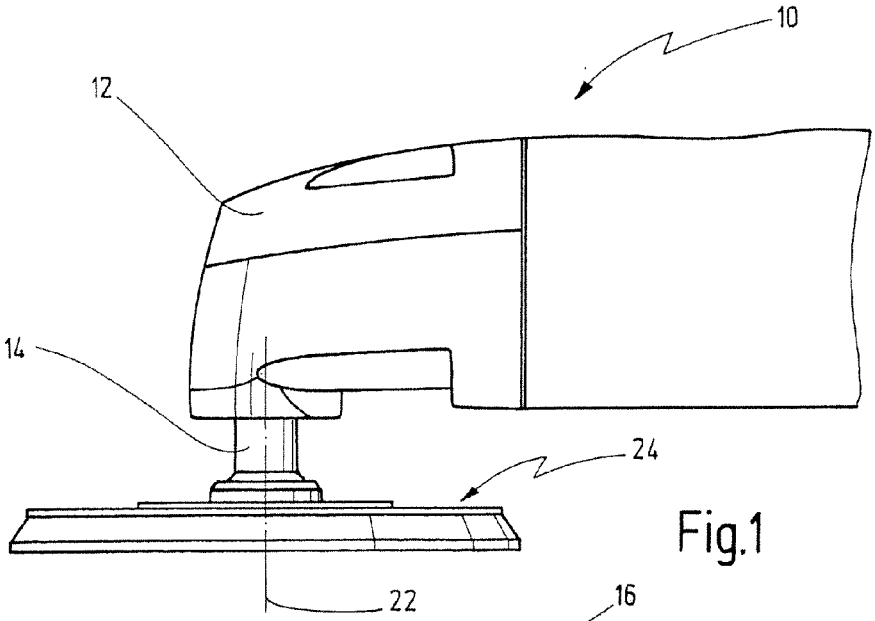
FIG. 1 shows a detail of an oscillating drive with the tool mounted on the work spindle of the oscillating drive.

FIG. 1 shows an oscillating drive of known design, in the area of its gearhead 12, indicated generally by reference numeral 10. The oscillating drive 10 comprises a work spindle 14 that can be driven by an oscillating drive (not shown) to oscillate and to rotate about its longitudinal axis 22. The spindle is driven at a high frequency of, for example, 5000 to 25000 oscillations per minute, and with a small oscillating angle of between approximately 0.5 and 7 degrees. A grinding or polishing tool 24 according to the invention is located on the outer end of the work spindle 14.

Known oscillating tools offered in the market have relatively small working surfaces, related to the drive power (power input in Watts) or to the total weight (in grams, without the tool).

For example, the quotient of the working surface and the drive power of oscillating tools offered in the market is between 9.5 and 33.86 $mm^2/W$, the quotient of the working surface and the weight is between 2.5 and 5.42 $mm^2/g$.

Now, the invention proposes a larger working surface, compared with the power input and the weight.

When a grinding disk with a diameter of 115 millimeters is used as a tool, an oscillating drive type Fein Multimaster FMM250, as marketed by Applicant, will result in a quotient of 41.42 $mm^2/W$ or a quotient of 8.66 $mm^2/g$, respectively.

When a grinding disk with a diameter of 115 millimeters is used as a tool, an oscillating drive type Fein Multimaster FMM250Q, as marketed by Applicant, will result in a quotient of 41.42 $mm^2/W$ or a quotient of 7.42 $mm^2/g$, respectively.

This means that the working surface is considerably increased for an otherwise identical drive.

The structure of the tool 24 will now be described in more detail with reference to FIGS. 2 to 8.

Figure 2:
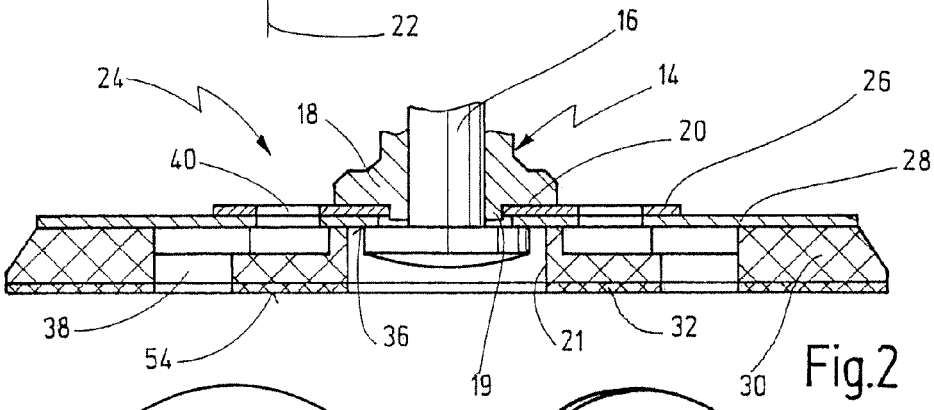
FIG. 2 shows an enlarged sectioned view of the tool of FIG. 1, in the region where it is mounted on the work spindle.

FIG. 2 shows an enlarged sectioned view of the tool 24 according to FIG. 1, mounted on the outer end of the work spindle 14.

The tool 24 has a disk-like design with a diameter of 115 mm on the working side.

Figure 3:
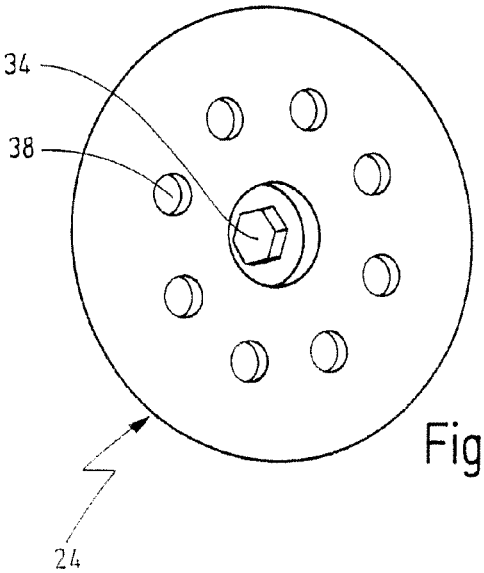
FIG. 3 shows a perspective view of the tool illustrated in FIG. 1, viewed from the working side.
Figure 4:
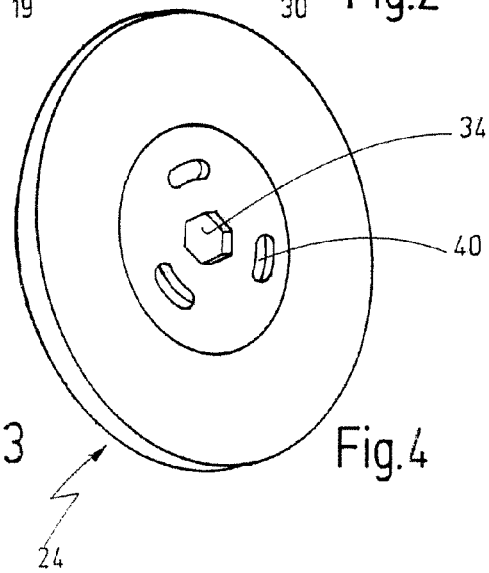
FIG. 4 shows a perspective view of the tool of FIG. 1, viewed from the rear.

The tool 24 comprises a driving element 26 made from steel, for example from CK85 having a Vickers hardness of 420 HV 50/30. The driving element 26 is provided with a central mounting opening, designed as a form-locking element 34, for example a hexagonal element as shown in FIGS. 3 and 4. The hexagonal form-locking element 34 of the driving element 26 is matched to a corresponding form-locking element 19 on the outer end of a spindle tube 18 of the work spindle 14. As a result, positive connection is achieved between the driving element 26 and the work spindle 14.

A plate-shaped back element 28 is fixed to the driving element 26 by gluing. The back element 28 has a larger surface, compared with the driving element 26, and preferably extends over the entire diameter of the tool 24. It serves to receive and to support a carrier element 30 which is glued to the back element 28 over its full surface. The back element 28 is made from an aluminum alloy, for example.

The carrier element 30 preferably consists of a slightly flexible material, for example a polyurethane. The outer surface of the carrier element 30, on the working side of the tool 24, is formed by an fastening element 32, preferably in the form of a Velcro-type material, on which a grinding or polishing material can be fixed from the outside.

Further, the carrier element 30 comprises a central opening 21. According to FIG. 7, the back element 28 has a central opening 48 of a diameter some-what smaller than the diameter of the recess 21 of the carrier element 30, but some-what larger than the outer dimensions of the form-locking element 34 of the driving element 26 (see FIG. 8).

Accordingly, as can be seen in FIG. 2, a mounting element 16, for example in the form of a bolt 16, can be introduced through the opening 21 of the carrier element 30 and into the tool 24 so that it comes to rest against the inside of the back element 28, in the clamping position illustrated in FIG. 2, and to fix the back element 28 together with the driving element 26 on the spindle tube 18. Due to the form-locking connection between the form-locking element 34 in the form of the hexagonal mounting opening on the driving element 26, and the correspondingly shaped form-locking element 19 on the spindle tube 18, a positive connection is achieved in this way. The back element 28 simultaneously serves as stop 36 in that case.

In addition to the central opening 21, additional exhaust channels 38 extend through the carrier element in this case, starting at the working side and extending through the carrier element 30, through the back element 28 and through the driving element 26 and ending in outlet openings 40 in the driving element 26. On that end, a suitable suction device may be provided to permit any grinding dust developing during the grinding operation to be removed directly in the working area.

Figure 6:
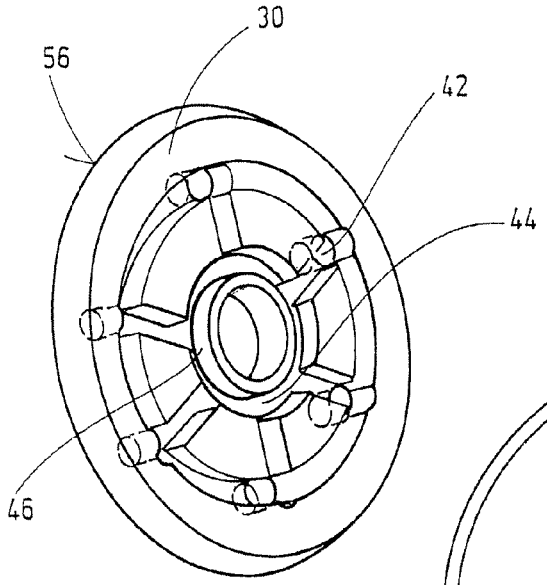
FIG. 6 shows a perspective view of the carrier element according to FIG. 5.
Figure 5:
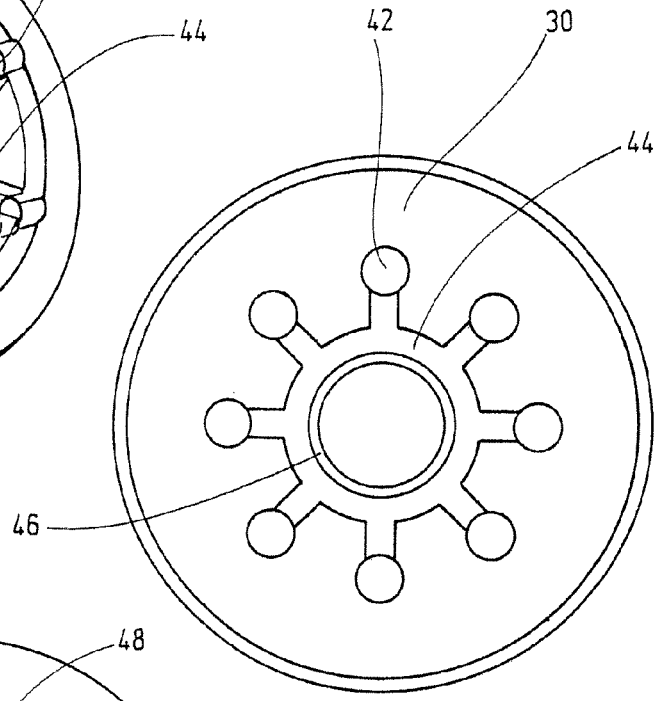
FIG. 5 shows a view of the carrier element according to FIG. 2, viewed from the rear.
Figure 7:
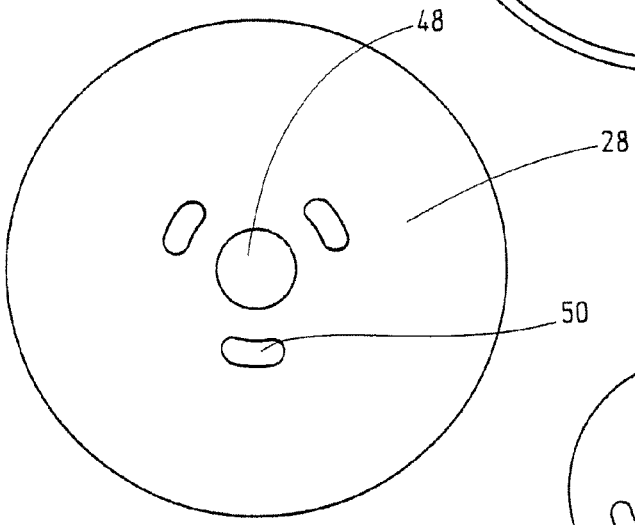
FIG. 7 shows a view of the back element according to FIG. 2.
Figure 8:
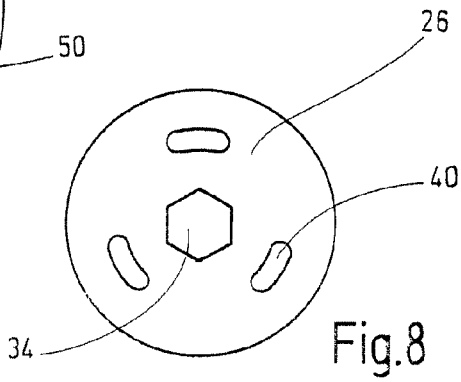
FIG. 8 shows a view of the driving element according to FIG. 2.

FIGS. 5 and 6 show the carrier element 30 in a view taken from the rear. It can be seen that the carrier element 30 comprises a total of eight axially extending passage openings 42 that open toward the back element 28 via a header duct 44 that is closed toward the center by an inner shoulder 46. A total of three intermediate openings 50 that open into the header duct 44 are provided in the back element 28. Three congruent outlet openings 40, arranged flush with the intermediate openings 50 of the back element 28, are arranged in the driving element 26 fixed on the back element 28.

Generally, very efficient dust removal from the working side can be ensured in this way by the carrier element 30, the back element 28 and the driving element 26.

The form-locking element 34 in the form of the mounting opening has a hexagonal shape in the illustrated embodiment. However, it is understood that the form-locking element 34 may also be given any other form provided corresponding adaptation to the matching form-locking element 19 of the work spindle 14 is ensured. For example, a twelve-point shape or any other polygonal shape may be used instead of a hexagonal shape. Especially, a star-shaped form with rounded bulges and concave projections arranged there between, as described for example by U.S. Pat. No. 6,945,862, would be imaginable. This patent is incorporated herein in full by reference.

Due to its two-part structure, comprising a driving element 26 and a back element 28 glued to the latter, the tool 24 described above has a weight clearly lower than the conventional tools where the driving element would cover the entire rear surface of the carrier element 30 and would also be made from steel for strength reasons, and in relation to the longitudinal axis 22 it shows a lower moment of mass inertia.

Due to that structure, the tool according to the invention can be used with advantage for surface grinding, in combination with an oscillating drive. One can obtain in this way a very intense grinding effect, superior to the grinding result obtainable with eccentric grinders of comparable size.

Figure 9:
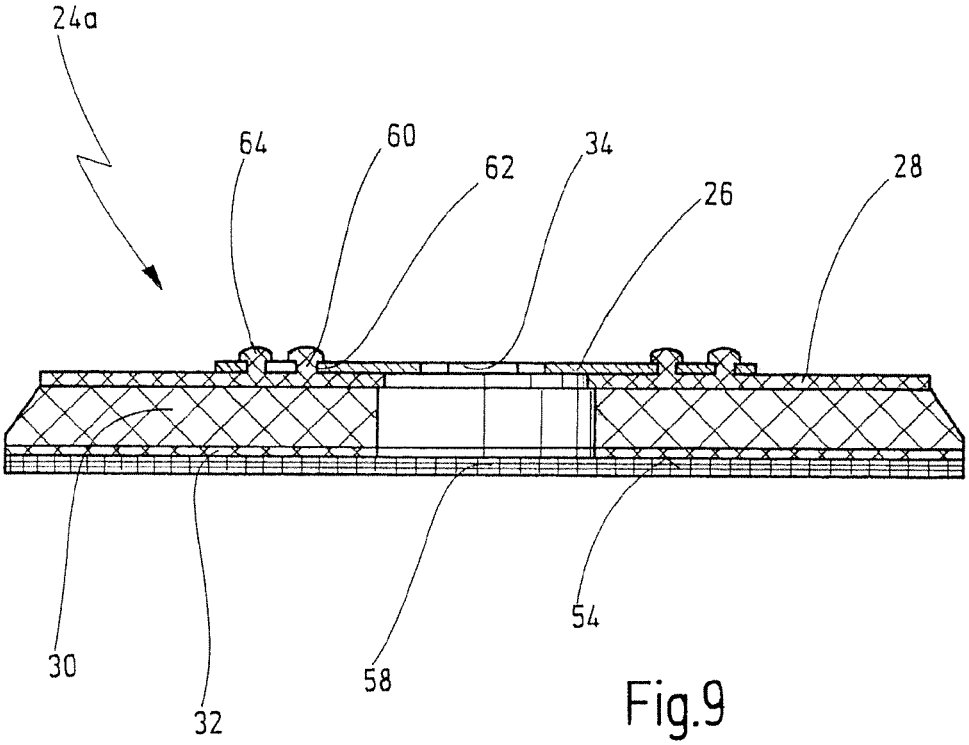
FIG. 9 shows a section through an embodiment of the tool according to the invention slightly modified relative to the embodiment of FIG. 2.

A modification of the tool according to the invention is illustrated in FIG. 9, and is indicated generally by 24*a*. That modified design differs from the one shown in FIG. 2 in that the driving element 26 is passed by a plurality of openings 62 which are positively engaged by matching projections 60 of the back element 28. On the rear, opposite the working side, those projections have been correspondingly enlarged, for example by the application of heat, so that enlargements 64 are obtained by which the driving element 26 and the back element 28 are firmly connected one with the other.

The back element 28 of that embodiment preferably consists of a plastic material produced by injection molding which, after fitting of the driving element 26, has been fused by the application of heat. In that case, gluing can be dispensed with.

The carrier element 30 is mounted on the back element 28 in the manner described before. A fastening element 32 in the form of a Velcro-type material is formed on the working side of the carrier element 30. As can be seen in the illustration of FIG. 9, a grinding or polishing element 58 is additionally applied to the surface of the fastening element 32 where it is retained by the effect of the Velcro-type fastening elements so that it can be exchanged easily.

It is understood that the described embodiment may be additionally provided with exhaust channels, if desired.

Further, it is understood that although the tool has been described above as a grinding disk, by way of example, any other form would be imaginable for the tool as well. For example, the tools used might have a triangular shape, if desired with rounded convex lateral edges, a rectangular shape, if desired with rounded convex lateral edges, a point on one side and a rounded portion on the other side (drop form), or the like. The advantages of the invention will in any case be achieved, irrespective of the shape of the working surface of the tool.

What is claimed is:

1. An oscillating tool machine comprising:

an oscillating drive having a drive motor, which has a given machine power (rated input power);

a work spindle driven rotatingly oscillatingly by said drive motor about a longitudinal axis thereof; and an oscillating tool attached releasably to said work spindle and having a working surface of a certain size for grinding and polishing;

wherein a quotient of the size of working surface of the tool (in square millimeters) and the rated power input (in Watts) of the drive motor is at least 35 $mm^2/W$.

2. The oscillating tool machine of claim 1, wherein said oscillating tool comprises:

a carrier element configured for holding a grinding or polishing material;

a driving element including a form-locking element for positive connection with the work spindle of the oscillating drive;

a back element to which said carrier element is fixed;

wherein said driving element has a higher strength than said back element; and wherein said back element is made from a material of lower density than a material from which said driving element is made.

3. An oscillating tool machine comprising:

an oscillating drive having a drive motor, which has a given deadweight in grams;

a work spindle driven rotatingly oscillatingly by said drive motor about a longitudinal axis thereof; and an oscillating tool attached releasably in form-locking fashion to said work spindle and having a working surface of a certain size (in square millimeters) for grinding or polishing;

wherein a quotient of the working surface and the deadweight of said oscillating drive without the tool (in grams) is at least 5.5 $mm^2/g$.

4. The oscillating tool machine of claim 3, wherein said oscillating tool comprises:

a carrier element configured for holding a grinding or polishing material;

a driving element including a form-locking element for positive connection with the work spindle of the oscillating drive;

a back element to which carrier element is fixed;

wherein said driving element has a higher strength than said back element; and wherein said back element is made from a material of lower density than a material from which said driving element is made.

5. The oscillating tool machine of claim 4, wherein said driving element is made from steel;

said back element consists of a material selected from the group consisting of an aluminum alloy and a magnesium alloy; and said carrier element consists of a plastic material.

6. The oscillating tool machine of claim 2, wherein the driving element is made from a material having a Vickers hardness of at least 250 HV.

7. The oscillating tool machine of claim 2, wherein said driving element is made from steel.

8. The oscillating tool machine of claim 2, wherein said back element consists of a material selected from the group consisting of an aluminum alloy and a magnesium alloy.

9. The oscillating tool machine of claim 2, wherein said driving element is fixed to said back element by a joint selected from the group consisting of a welding joint, a soldering joint, and a gluing joint.

10. The oscillating tool machine of claim 2, wherein said driving element comprises a plurality of openings for reducing weight of said driving element.

11. The oscillating tool machine of claim 2, wherein the back element comprises a plurality of openings for reduce weight of said back element.

12. The oscillating tool machine of claim 2, wherein said back element comprises projections configured for positively engaging matching openings provided on said driving element.

13. The oscillating tool machine of claim 12, wherein said projections of said back element are connected with openings on said driving element by caulking or fusing.

14. The oscillating tool machine of claim 2, wherein the carrier element consists of an elastomeric material.

15. The oscillating tool machine of claim 1, wherein said oscillating tool is disk-shaped and has a working surface with a diameter larger than 100 mm.

16. The oscillating tool machine of claim 2, further comprising exhaust channels which extend through said carrier element, said back element and through said driving element.

17. The oscillating tool machine of claim 2, wherein said carrier element comprises a fastening element on a side facing the tool, for detachably fastening said grinding or polishing material.

18. The oscillating tool machine of claim 17, wherein said fastening element consists of a Velcro-type material.

* * * * *